US005749411A

United States Patent [19]

Zielinski et al.

[11] Patent Number: 5,749,411

[45] Date of Patent: May 12, 1998

[54] SPRUING ASSEMBLY

[75] Inventors: David M. Zielinski, West Seneca; Melvin A. Engelman, Wappingers Falls, both of N.Y.

[73] Assignee: Dentifax International, Inc.

[21] Appl. No.: 675,989

[22] Filed: Jul. 9, 1996

[51] Int. Cl.[6] ..... B22C 7/02

[52] U.S. Cl. ..... 164/244; 164/246; 164/235

[58] Field of Search ..... 164/244, 235, 164/246, 376, DIG. 4

[56] References Cited

U.S. PATENT DOCUMENTS

| | | | |
|---|---|---|---|
| 3,340,923 | 9/1967 | Benfield | 164/244 |
| 3,985,178 | 10/1976 | Cooper | 164/237 |
| 4,081,019 | 3/1978 | Kulig . | |
| 4,558,841 | 12/1985 | Engleman et al. | 249/54 |
| 4,676,294 | 6/1987 | Berger | 164/244 |
| 4,972,897 | 11/1990 | Thomas | 164/35 |

*Primary Examiner*—Scott A. Smith
*Assistant Examiner*—L-H. Lin
*Attorney, Agent, or Firm*—Edwin Lester

[57] ABSTRACT

A spruing assembly for receiving investment material in the production of an investment mold for castings by the "lost wax" process which includes a hollow chamber to receive the investment material. Included within the chamber is one or more sprue for supporting the wax pattern(s) to be cast and one or more corresponding predetermined shaped reservoir(s) being slidably moveable up or down the sprue to create the heat center of the investment mold. Where a long span casting is to be produced all the reservoirs are connected to form a continuous reservoir or Feeder Bar which conforms to the curve of a long span dental arch. A base member is provided within the chamber for supporting the sprue.

8 Claims, 1 Drawing Sheet

SPRUING ASSEMBLY

BACKGROUND OF THE INVENTION

The present invention relates to investment casting, and more specifically, to a spruing assembly for receiving investment material in the production of investment mold castings.

In dental technology, castings are used to restore dental structures and diseased teeth to their original or modified anatomy. The cast restorations can take two forms, namely a crown or inlay or a coping. In the form of a crown or inlay, the cast restoration itself actually has all the required anatomy whereas, in the form of a coping, the casting merely serves as a metal substrate to which is bonded porcelain sculpted into the desired dental anatomy. These dental castings may restore a single tooth, or they may restore multiple teeth as in a bridge or splint.

For many years the Lost Wax Process employed sprues in the production of dental, jewlery and other industrial castings. The sprues, which may be plastic, metal or wax, are mounted on a crucible former which is positioned at the base of a cylinder or casting ring. The sprue extends up into the ring and supports a wax pattern of the design to be cast. In dentistry, the part to be cast is created in wax on a duplicate of the tooth being restored, the duplicate being called a die. After the wax pattern on the die is completed a sprue is attached to it and using the sprue as a handle, the wax pattern is removed from the die and the free end of the sprue is inserted into the crucible former of a base and a ring is placed around the base. The ring is filled with investment which is a cement-like refractory material. After reaching final set, the investment is heated in an oven to melt and eliminate the sprues and wax pattern to drive out gases and moisture, this being termed the burnout step, Molten alloy is then cast through the sprue channel into the resulting mold cavity in the investment.

In dental technology, the sprues are often equipped with enlargements along their proximal end, known as reservoirs. These reservoirs provide a ready supply of molten alloy during the casting process until all the parts of the wax empty chamber have been filled, thus reducing the porosity and the occurrence of voids i.e. empty areas, in the casting. The use of reservoirs has been discussed previously in U.S. Pat. No. 3,340,923 issued to J. W. Benfield on Sep. 12, 1967, and in U.S. Pat. No. 4,081,019 issued to F. M. Kulig on Mar. 28, 1978. In both of these patents the reservoir is an integral, fixed part of the sprue.

One of the problems that arise with this arrangement is that the reservoir cannot be moved on the sprue; there is no way to modify the effect of the reservoir as needed by castings of various sizes and alloys.

This invention has a novel reservoir that can be placed at any location on the sprue, as determined by the user to be the most effective in its function according to the alignment of the sprue, the size of the casting and the alloy being used. The sprues which may be plastic, wax or metal, hollow or solid, are provided in any gauge and length. A sprue is selected of a gauge suitable for each particular casting and cut to a length appropriate for each specific use.

Another problem that arises with reservoirs that are a fixed part of the sprue is that the reservoir may not be positioned at the heat center of the mold and therefore would not ensure the availability of sufficient molten alloy. It is important that the alloy remain molten until all parts of the wax empty chamber are supplied with sufficient alloy to yield a perfect casting. The reservoir's diameter is larger than the sprue's and thus has more bulk to hold heat which is necessary to keep the alloy molten during the casting process until all the investment cavities have been filled without voids. "Heat Soaking" insures that the heat center of the mold is kept as hot as possible to help maintain the alloy in its molten state. Thus, during burnout, the investment mold is heat soaked or held for 30 minutes or more at the maximum temperature of the investment being used (1400–1700 degrees F). The heat center is created by the bulk of reservoirs and is insulated by the surrounding mass of investment. The heat center is the area of the investment mold that retains the heat longer than other areas and alloy in it remains molten longer and is able to supply molten alloy to all parts of the wax-empty mold being cast. Thus, the location of the reservoir(s) is critical to this process. Hence, by adjusting sprue length and having movable reservoirs, one has the flexibility in positioning the reservoir (s) and the wax pattern properly in relation to the heat center of each mold and the reservoir(s) can then be locked into the desired position on the sprue with molten wax.

Still another problem that arises with fixed reservoirs occurs when the configuration of sprues vary depending upon the length of the restoration being involved in the restoration. Thus, the longer the restoration the greater the number of sprues that will be required and if the restoration has multiple units that vary in thickness it will require sprues of various gauges. Additionally, some alloys function better with short sprues while other alloys are best served by longer sprues. Thus, all these variations necessitate flexibility in positioning the reservoirs so they can function ideally within the heat center of the mold i.e. by being the last part of the casting to cool and solidify they are thus able to supply molten alloy to the wax empty chamber allowing it to completely fill without voids or defects.

Another problem that arises with fixed reservoirs occurs when the configuration of sprues vary depending upon the curvature of the dental arch involved in the restoration. In such applications, the casting requires multiple sprues at various positions and angles. When reservoirs are locked into fixed locations on sprues, segments can be cast consisting only of a few units because as they progress along the arch the fixed reservoirs no longer fall within the mold's heat center. Accurately assemblying the short segments into a final full span is difficult and may not be possible.

The present invention eliminates the rigidity of spruing where reservoirs are locked into a fixed position on the sprue inasmuch as the reservoirs are freely located on the sprue and therefore maintained in the mold's heat center. Therefore, a long span restoration following the curve of the dental arch is no longer an obstacle to one-piece casting because the sprues with their adjustable reservoirs can follow the curvature of the arch. At the conclusion of spruing, the individual reservoirs can be connected with wax, which, in turn, creates a continuous reservoir of molten alloy during casting. Thus, long span castings of multiple restorations as a single unit can be routinely produced.

Another advantage of the present invention provides the ideal spruing system for casting multiple units as a one-piece casting that eliminates the requirement for soldering. Soldering to connect multiple units is not only time consuming but errors of fit in units is often caused by the actual technique of soldering. To be able to eliminate soldering is a significant advance in the accuracy of the fit of multiple unit restorations and construction of implant superstructures. For most accurate results to obtain a one-piece casting, hollow plastic sprues may be used with a ringless casting which eliminate the requirement for soldering.

Further, whether the arrangement of multiple sprues is in a "tee-pee" alignment, in a vertical alignment or in a horseshoe alignment, they are all easily adaptable with the present invention-to produce accurate one-piece castings.

Present technology utilizes either a solid plastic or wax rod to create a Feeder(Runner) Bar for spruing multiple units. A hollow plastic device has been disclosed in U.S. Pat. No. 4,558,841 issued to M. Engleman et al on Dec. 17, 1985 for spruing multiple units. Plastic is superior to wax in that it provides resistance to distortion and fracture of the sprued ensemble. Hollow plastic is superior to solid plastic in that there is no concern that the hollow plastic will expand during burnout and crack the investment mold. Unfortunately, none of these devices are completely satisfactory in that they either do not permit spruing a long restoration that follows the dental arch or provide rigidity of the ensemble when it is removed from the dies and placed in the crucible former.

Using the present invention, a custom made Feeder (Runner) Bar is created that has the strength of plastic and the advantages of hollow plastic by connecting all the reservoirs with wax. With spruing completed the entire unit can be removed without fear of distortion of the sprues or Feeder Bar and then placed in the crucible former of the base. If there is no distortion or cracking of the sprues or the wax patterns as they are removed from the dies, it is assured that the one-piece casting will be made that will be reseated on the dies and subsequently on the patient's teeth perfectly.

Accordingly, it is an object of the invention to provide an enhanced spruing assembly for producing high quality castings of either a minimal number of units or of long multiple unit spans.

Another object of the invention is to provide an improved spruing assembly which provides reservoir means slidably moveable up or down a sprue means to within the heat center of the investment mold.

Still another object of the invention is to provide a spruing assembly in which a reservoir, which is provided for a sprue, has a predetermined shape and surface which will distribute stress equally over its entire surface in the investment mold to avoid voids or defects when supplying molten alloy to the spruing assembly.

A further object of the invention is to provide a novel spruing assembly for casting multiple units as a one-piece casting.

Still a further object of the invention is to create a hollow plastic Feeder (runner) Bar for long spans that will accurately follow the curve of a dental arch.

SUMMARY OF THE INVENTION

High quality castings of individual a multiple parts is achieved in accordance with the present invention by using a spruing assembly which includes a base and a centralized sprue base former supporting one or more sprue means upon which is slidably mounted a reservoir means and located within the heat center of the investment mold. When the spruing assembly is to be used for casting multiple units as a one-piece casting, a plurality of sprue means is provided together with corresponding reservoirs which are connected together to effectively form a Feeder Bar to create a continuous reservoir for molten alloy during the casting process. A plastic tapered ring is provided which engages the base and surrounds the spruing assembly to form a hollow chamber to receive the investment material.

The foregoing and other objects, features and advantages of the invention will be apparent from the following particular description of a preferred embodiment of the invention, as illustrated in the accompanying drawings.

DETAILED DESCRIPTION

Figure 1:
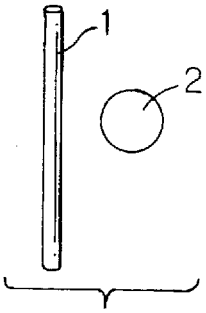
FIG. 1 is a view of a sprue and reservoir of the present invention.
Figure 2:
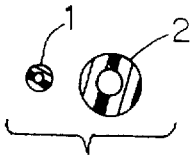
FIG. 2 is a cross section of the sprue and reservoir shown in FIG. 1.
Figure 3:
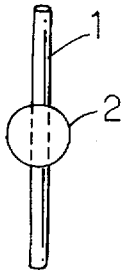
FIG. 3 is a view of a reservoir positioned on a sprue.

Referring to the drawings, and particularly to FIG. 1, the sprue 1 may consist of a hollow plastic tube and the reservoir 2 may consist of a hollow plastic ball that fits on the sprue and can be moved up or down theron so it may be secured in the most ideal position on the sprue in order to maximize its function as a reservoir of molten alloy and heat source. Referring now to FIG. 2, there is shown a cross section of the sprue 1 with its hollow opening and of the reservoir 2 with its hollow opening to allow it to be positioned on the sprue 1 as shown in FIG. 3.

The sprue 1 may be of any gauge but for purposes of describing this invention it may be of 6 gauge, 8 gauge or 10 gauge. Likewise, the length of the sprue 1 may vary but is determined by the distance of the wax pattern to be molded from the support for the sprue 1. Sprues will be provided greater than this distance so that they may be cut to the preferred length as determined by the requirements of each casting. The sprue 1 may be solid wax or plastic but hollow plastic is preferred because of plastic's superior strength and hollow to lessen the possibility of damaging the investment mold during burnout.

The reservoir 2 that fits on the sprue 1 is preferably round in shape with a smooth curved surface to distribute stress equally over its entire surface so as not to create undo pressure during burnout. The reservoir 2 is hollow with openings on opposite sides in order to allow the sprue 1 to pass through. Because solid plastic expands during burnout before it melts and vaporizes, the expansion can damage the investment walls surrounding it, wheras, if the plastic is hollow, as is the case in the present invention, it does not expand but instead, will collapse on the hollow space so there is no concern about damage to the investment mold. The diameter of the reservoir 2 will vary according to the gauge of the sprue 1 and is usually about double the sprue diameter. The position of the reservoir 2 from the wax pattern to be molded is preferably in the range of 2 mm(0.0788 inches) to 7 mm(0.2758 inches).

The present invention can be used for casting single units but its greatest benefit is for casting multiple units or large castings 20 which require multiple sprues and for the elimination of the need for soldering these units into one piece as soldering can introduce errors in the accuracy of the fit of the casting. In addition to the disadvantages of solid reservoirs discussed above, reservoirs as described in U.S.

Pat. No. 3,985,178 issued to A. J. Cooper on Oct. 12, 1976 cannot be used for more than four units because the flat ends of the reservoirs do not permit desirable positioning of the reservoirs. Either they must be cut away to permit good connections or the corners will overlap forcing the tops apart. If only the corners are connected proper positioning of the wax patterns is not possible. Square reservoirs introduce a serious additional problem in that the angles of the corners upset the smooth flow of molten alloy as it flows through to the mold cavity. All of the casting spaces must be smooth and curved in order to eliminate turbulence in the flow as turbulence is responsible for voids and defects in the completed casting. The round reservoirs of the present invention eliminate these placement difficulties and permit the maximum number of wax patterns to be utilized simply by adjusting the position of the reservoir on each sprue.

Figure 4:
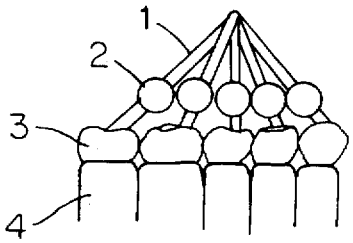
FIG. 4 is a view of multiple sprues attached to wax patterns overlaying multiple dies with a plurality of associated reservoirs positioned on the sprues.

Referring now to FIG. 4 there is shown a plurality of sprues 1 of appropriate length and gauge being attached to a wax pattern 3 overlapping multiple dies 4. Hollow round reservoirs 2 with openings at each end which correspond to the sprue diameters are placed on the sprues within the 2 mm–7 mm distance from the wax patterns 3. Solid round or rectangular reservoirs can be used rather than hollow round reservoirs but they have serious disadvantages. Solid reservoirs are more likely to damage investment mold during burnout in the same manner as already described for solid sprues. Rectangular reservoirs are much more likely to create problems than round reservoirs. The corners of rectangular reservoirs localize stress at a point to create greater impact on the investment than a round surface which will distribute stress over its entire surface. Corners in the investment mold lead to turbulence, mold cracking or finning which produce distorted finished castings.

After all the sprues 1 have been attached to the wax-up, the reservoir positions are adjusted on the sprues 1 so that they are all in the same horizontal level. The reservoirs 2 are then firmly secured in place with wax and connected to each other with wax thus forming a continuous reservoir from one end of the wax-up to the opposite end as shown in FIG. 4. This continuous reservoir, known as a Feeder Bar, is a continuous bar with all portions becoming mutually supporting in function. This Feeder Bar is more effective than those heretofore in that it has been custom made for each individual case to adapt in shape to the curve of the dental arch and to the irregularities in size and position of the individual waxed units.

The dental arch which supports teeth is a rough curve as it moves from the posterior molar area of one side of the jaw forward around the anterior area and then back posteriorty to the opposite molar area. The canine areas on the left and right sides exhibit the greatest angulation and deviation from a gentle curve. A restorative span of wax patterns following this curve will demonstrate unequal spaces between the wax patterns and their sprues as well as different sprue lengths. If the span includes the canine areas, the variations will be increased. By utilizing sprues of different lenths and positioning the reservoirs optimally on each sprue, one can compensate for the differences created by the curve of the dental arch. The present invention makes this possible and unlike previous efforts, the length of the span is not limited to only three or four units.

Figure 5:
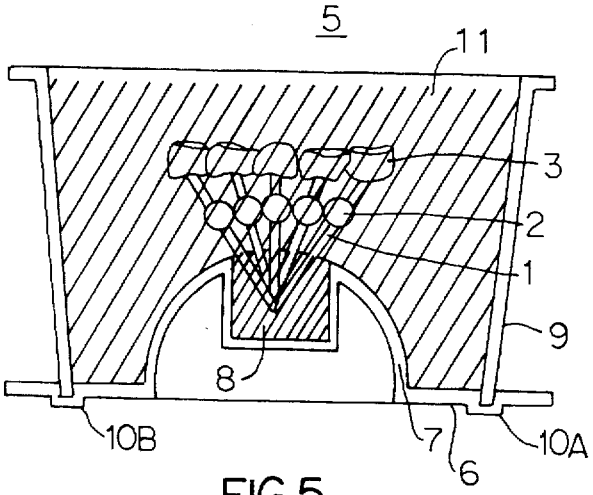
FIG. 5 is a sectional view, partly broken away, of the spruing assembly embodying the present invention with all the reservoirs connected together to form a continuous Feeder (Runner) bar and surrounded by investment material which develops the investment mold.

Referring now to FIG. 5, the spruing assembly, indicated generally by reference numeral 5, constructed according to the invention, includes a base member 6 having a centralized sprue base former 7 filled with a wax plug 8 and a casting ring 9 supported by the base member 6 to form a hollow chamber to receive investment material 11. The base member 6 may be made of plastic material and be predetermined in shape. The base former 7 is ellipsoidal in shape and has an opening at the top to receive the wax plug 8. Special designed grooves 10A and 10B are provided in the base member 6 to receive and securely maintain the ring 9. The base member is reusable since it is removed after the investment material has set. The casting ring 9 may be made of plastic material and is tapered toward the bottom of the ring 9 to facilitate removal of the investment mold by popping it out after the final set of the investment which thereby permits the ring 9 to be reusable. While the plastic ring 9 is shown in FIG. 5 as having a graduated round shape, it should be apparent that it is within the skill of the art to use other shapes, as for example, oval shapes with, of course, the shape of the grooves of the base member 6, being-of similar shape to receive and secure the ring 9 in the base member 6 of the assembly 5.

Figure 6:
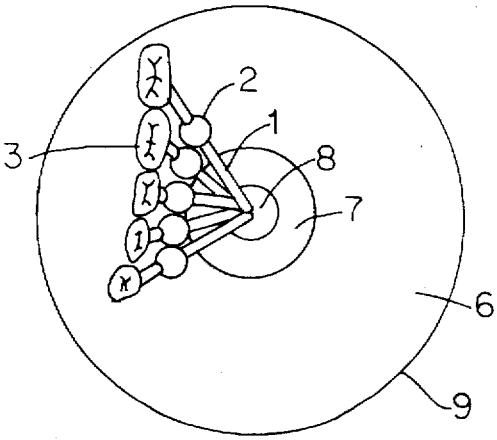
FIG. 6 is a vertical view of the spruing assembly embodying the present invention showing the different lengths of the sprues as they follow the curve of a dental arch and the reservoirs positioned in a continuous arc regardless of the lengths of the associated sprues.

Referring now to FIGS. 4 to 6, when proceeding with the casting of a dental item and the like, in accordance with the invention, the combination of the sprues 1 and Feeder Bar of associated reservoirs 2 connected to the wax patterns 3 is removed from the dies. The tee-pee arrangement of sprues 1 is then inserted into the wax plug 8 of the sprue base former 7 as shown in FIG. 5. FIG. 6 shows a vertical view of the assembly 5 which demonstrates the different lengths of the sprues as they follow the curve of the dental arch. It is to be noted that all the reservoirs 2 are positioned in a continuous arc regardless of the length of the sprues 1. Following this, the proper size ring 9 is inserted into the grooves 10A and 10B of the base member 6 to form the hollow chamber for receiving the investment material.

High heat resistant investment material is next poured into the ring to completely surround the wax patterns 3, sprues 1 and reservoirs 2 and allowed to set for a predetermned period of time. After the investment material has set, the investment mold is removed and then placed into a burn-out oven and heated to a high temperature. As the temperature rises, the wax in the investment mold begins to melt and is conducted out through the sprues. As the temperature continues to rise, the wax pattern, sprues and Feeder Bar begin to melt creating hollow internal spaces. As the heating continues the melting and liquifying, the melted wax and plastic flows out through the spaces created by the melted sprue members. After all the wax and plastic have been melted out of the mold, leaving a cavity in the mold, the investment mold is placed in a casting machine which is used to force molten alloy into the investment mold by the centrifugal action of the casting machine. After the casting is completed, the investment mold is broken away from the cooled metal and individual items can be cut off the cast assembly, cleaned and fitted onto the dies of the model.

Thus, with this arrangement of the present invention, multiple units may be obtained with one casting operation.

While the invention has been particularly shown and described with reference to a preferred embodiment hereof, it will be understood by those skilled in the art that several changes in form and detail may be made without departing from the spirit and scope of the invention. Accordingly, it is intended by the appended claims to cover all such modifications and changes as fall within the true spirit and scope of the invention.

We claim:

1. A spruing assembly for receiving investment material in the production of an investment mold for castings comprising:

a multiple unit to be cast comprising a plurality of wax patterns, a plurality of sprues connected at one ends thereof to corresponding ones of said plurality of wax patterns, said plurality of sprues being in a tee-pee arrangement in which one sprue of said plurality of sprues is in a vertical position and the remaining ones of said plurality of sprues are angled toward said one sprue whereby said plurality of sprues are of different lengths, a plurality of reservoirs maintained on said plurality of sprues being shaped so as to uniformly distribute stress over its entire surface and spaced a predetermined distance from said plurality of wax patterns, said plurality of reservoirs being moveably positioned on said plurality of sprues so that all of said reservoirs are connected together and maintained at the same horizontal level to thereby create a heat center for the investment mold despite the differing lenghts of said plurality of sprues, a hollow chamber, base means within said chamber, the other ends of said tee-pee arranged plurality of sprues being inserted in said base member to thereby provide support for the combination of said plurality of sprues, said plurality of reservoirs and said plurality of wax patterns, and investment material contained within said chamber surrounding said plurality of sprues, said plurality of reservoirs and said plurality of wax patterns.

2. An assembly according to claim 1 in which said other ends of said tee-pee arranged plurality of sprues are connected to a common point.

3. An assembly according to claim 1 in which said plurality of reservoirs are of a predetermined shape and surface so as to distribute stress over their entire surface in said investment mold.

4. An assembly according to claim 1 in which said plurality of reservoirs are round and ball shaped with a smooth surface to avoid local stress and turbulence in the investment mold.

5. An assembly according to claim 1 in which said plurality of reservoirs have hollow interiors.

6. An assembly according to claim 1 in which said plurality of reservoirs are positioned on said plurality of sprues between 2 mm and 7 mm from said plurality of wax patterns.

7. An assembly according to claim 1 in which said plurality of sprues consist of hollow plastic tubes.

8. A spruing assembly for receiving investment material in the production of an investment mold for casting multiple units as a one-piece casting comprising:

a multiple unit to be cast comprising a plurality of wax patterns which conform to the curve of a long span arch, a plurality of sprues connected at one ends thereof to corresponding ones of said plurality of wax patterns and arranged to follow the curve of the long span arch of said pluality of wax patterns, said plurality of sprues being in a tee-pee arrangement in which one sprue of said plurality of sprues is in a vertical position and the remaining ones of said plurality of sprues are angled toward said one sprue whereby said plurality of sprues are of unequal lengths, a plurality of reservoirs maintained on said plurality of sprues and spaced a predetermined distance from said plurality of wax patterns, said plurality of reservoirs being round and ball shaped with a smooth surface and moveably positioned on said plurality of sprues so that all of said reservoirs are connected together to form a continuous span following the curve of the long span arch, said continuous span of reservoirs being maintained at the same horizontal level to thereby create a heat center for the investment mold despite the different lengths of said plurality of sprues, a hollow chamber, base means within said chamber, the other ends of of said tee-pee arranged plurality of sprues being inserted in said base member to thereby provide support for the combination of said plurality of sprues, said continuous span of reservoirs maintained on said plurality of sprues and said plurality of wax patterns all of which conform to the curve of said long span arch, investment material contained within said chamber surrounding said plurality of sprues, said continuous span of reservoirs and said plurality of wax patterns.

* * * * *